US006628792B1

(12) United States Patent
Paddock

(10) Patent No.: US 6,628,792 B1
(45) Date of Patent: Sep. 30, 2003

(54) BACK TO BACK MOUNTED COMPOUND WOOFER WITH COMPRESSION/BANDPASS LOADING

(76) Inventor: Paul W. Paddock, 5001 NE. Mineral Springs Rd., McMinnville, OR (US) 97128

( * ) Notice: Subject to any disclaimer, the term of this patent is extended or adjusted under 35 U.S.C. 154(b) by 0 days.

(21) Appl. No.: 09/281,720

(22) Filed: Mar. 30, 1999

Related U.S. Application Data

(60) Provisional application No. 60/079,955, filed on Mar. 30, 1998.

(51) Int. Cl.[7] ..... H04R 25/00

(52) U.S. Cl. ..... 381/182; 381/336; 381/386; 181/153; 181/199

(58) Field of Search ..... 381/304, 305, 381/300, 308, 332, 335, 336, 337, 338, 339, 342, 345, 346, 347, 348, 349, 351, 352, 160, 163, 357, 182, 421, 89; 181/153, 155, 156, 199, 144

(56) References Cited

U.S. PATENT DOCUMENTS

| | | | | | |
|---|---|---|---|---|---|
| 1,568,589 | A | * | 1/1926 | Eddington | 381/342 |
| 1,578,595 | A | * | 3/1926 | Frantz | 381/185 |
| 2,790,164 | A | * | 4/1957 | Oberg | 381/342 |
| 3,393,764 | A | * | 7/1968 | Schafer | 381/182 |
| 4,268,719 | A | * | 5/1981 | Manger | 381/308 |
| 4,301,332 | A | | 11/1981 | Dusanek | 179/1 E |
| 5,475,764 | A | | 12/1995 | Polk | 381/159 |
| 5,535,284 | A | | 7/1996 | Thornhill et al. | 381/154 |
| 6,009,972 | A | * | 1/2000 | Choi et al. | 181/155 |
| 6,035,051 | A | * | 3/2000 | Sato | 381/342 |

* cited by examiner

*Primary Examiner*—Curtis Kuntz
*Assistant Examiner*—Suhan Ni
(74) *Attorney, Agent, or Firm*—Glenn C. Brown

(57) ABSTRACT

The back to back mounted compound woofer that improves sound quality by minimizing mechanical vibrations is provided. The woofer speakers of the present invention are under compression allowing for more efficient cone motion control resulting in a lower cutoff and thus, resonant, frequency. Since the compound woofer of the present invention minimizes size, material, and electrical and custom components, it is inexpensive to manufacture. A housing provides an enclosure for the compound woofer. The housing includes opposed sidewalls or side plates, each having a coaxial opening. Each of two speakers is mounted on a respective coaxial opening of a respective sidewall. Additionally, the two speakers are mounted back to back, i.e., with their magnet structures in close proximity to one another. In one embodiment, the magnet structures are coupled to one another using a flexible sealing compound such as putty. In another embodiment, the two woofers share a common unitary magnet structure. The containing volume around the speakers is made as small as physically possible by using, in one embodiment, a spiral curve member to form a substantially circular woofer housing around the woofers. The spiral curve member maintains an even distance between the two sidewalls and supports the two sidewalls. The spiral curve member forms an exit that is the main exhaust of the two woofers. In other embodiments, the containing volume around the speakers is minimized using a six-sided box or a tube. The box or tube housing is confined within an external enclosure. A vent connects the box or tube and the enclosure for venting the pair of speakers to the outside.

16 Claims, 5 Drawing Sheets

BACK TO BACK MOUNTED COMPOUND WOOFER WITH COMPRESSION/BANDPASS LOADING

This application claims the benefit of provisional application No. 60/079,955 filed Mar. 30, 1998.

BACKGROUND OF THE INVENTION

1. Field of the Invention

This invention relates generally to a speaker (or audio transducer) for reproducing bass frequencies and, more particularly, to a back to back mounted compound woofer with compression/bandpass loading.

2. Description of the Prior Art

The prior art in woofer designs is very well known and can be characterized by the quest for greater performance in ever-smaller packages. Large woofers in small boxes with very high power modifiers employing motional feedback to maintain linearity are commonly found now. If capable of good sound quality they are quite expensive and because of the extraordinary punishment delivered to the transducer to overcome the physical constraints inherent in these designs, can develop mechanical trouble and fail over time.

It should be noted that this new invention is not antagonist to these other design approaches, indeed a marriage could be quite beneficial, but that very conservatively designed transducers employing modest power amplifiers can yield exceptional results in an acceptable package size and cost.

SUMMARY OF THE INVENTION

A pair of woofer speakers or low frequency transducers, when mounted and operated as disclosed herein will exhibit a lower resonant frequency, higher sensitivity (or conversion of electrical to acoustic power), and better rejection of frequencies above its desired operating range, than would be expected, by well known calculations.

The device is very stable mechanically and because of this, unwanted or parasitic vibrations are practically nonexistent. This allows use of a much more lightly constructed enclosed without extensive cross bracing than would otherwise be employed. It is also very advantageous in car applications where available mounting panels are by nature, flimsy.

A housing provides an enclosure for the compound woofer. The housing includes opposed sidewalls or side plates, each having a coaxial opening. Each of two speakers is mounted on a respective coaxial opening of a respective sidewall. Additionally, the two speakers are mounted back to back, i.e., with their magnet structures in close proximity to one another. In one embodiment, the magnet structures are coupled to one another using a flexible sealing compound such as putty. In another embodiment, the two speakers share a common unitary magnet structure. The containing volume around the speakers is made as small as physically possible by using, in one embodiment, a spiral curve member to form a substantially circular woofer housing around the speakers. The spiral curve member forms an first enclosed channel that is the main exhaust of the two woofers. A curve member together with the spiral curve member forms a primary vent for venting the woofer output. The spiral curve member and the curve member maintain an even distance between the two sidewalls and support the two sidewalls. In other embodiments, the containing volume around the speakers is minimized using a six-sided box or a tube. The box or tube housing is confined within an external enclosure. A vent connects the box or tube and the enclosure for venting the pair of speakers to the outside.

BRIEF DESCRIPTION OF THE DRAWINGS

The foregoing and other objects, features, and advantages of the invention will become more readily apparent from the following detailed description of a preferred embodiment that proceeds with reference to the following drawings.

DETAILED DESCRIPTION OF THE PREFERRED EMBODIMENT

Figure 1:
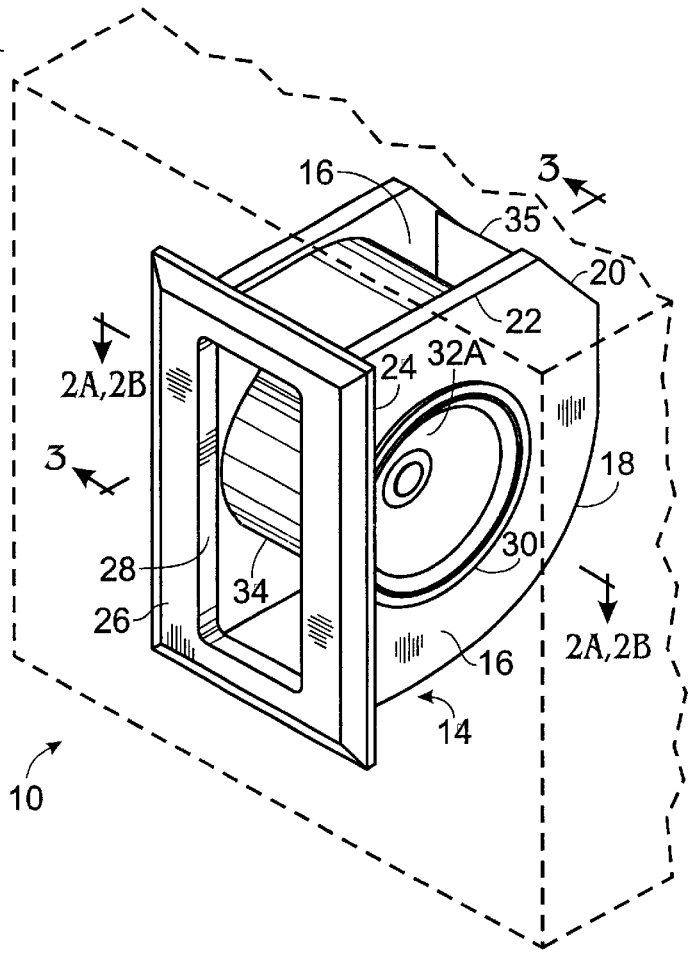
FIG. 1 is a perspective view of a first embodiment of the back to back mounted compound woofer of the present invention.

Referring to FIG. 1, the compound woofer 10 includes an outer enclosure 12 for supporting a speaker housing 14. The housing 14 includes two opposed sidewalls or side plates 16, each having a curved portion 18, a sloped portion 20, a straight portion 22, and a face portion 24. The housing 14 includes a faceplate 26 communicating with the face portion 24 and having an opening 28. The opening 28 together with the housing 14 form a first enclosed channel that is main exhaust of the speakers 32A and 32B. The faceplate 26 overlays the enclosure 12 for providing an aesthetically pleasing front end to the compound woofer 10.

Each sidewall 16 includes a coaxial opening 30 for mounting a speaker 32A or 32B to the housing 14. The two sidewalls are connected together and maintained at a predetermined distance from each other through a spiral curve member 34 and a curve member 35. The housing 14 can be made of a variety of materials including wood, plywood, cardboard fiber material, plastic, and the like. Since the spiral curve member 34 and the curve member 35 curve around the speakers 32A and 32B, they must be made of a flexible material such as plywood, e.g., the flexible plywood WiggleWood® manufactured by North American Plywood Corporation of California. A person skilled in the art should recognize that the housing 14 could also be manufactured using injection-molded processes by, for example, dividing the housing into halves and later fusing the halves together. An injection molded housing 14 is particularly suited for high volume, smaller systems such as those used in cars.

Figure 2A:
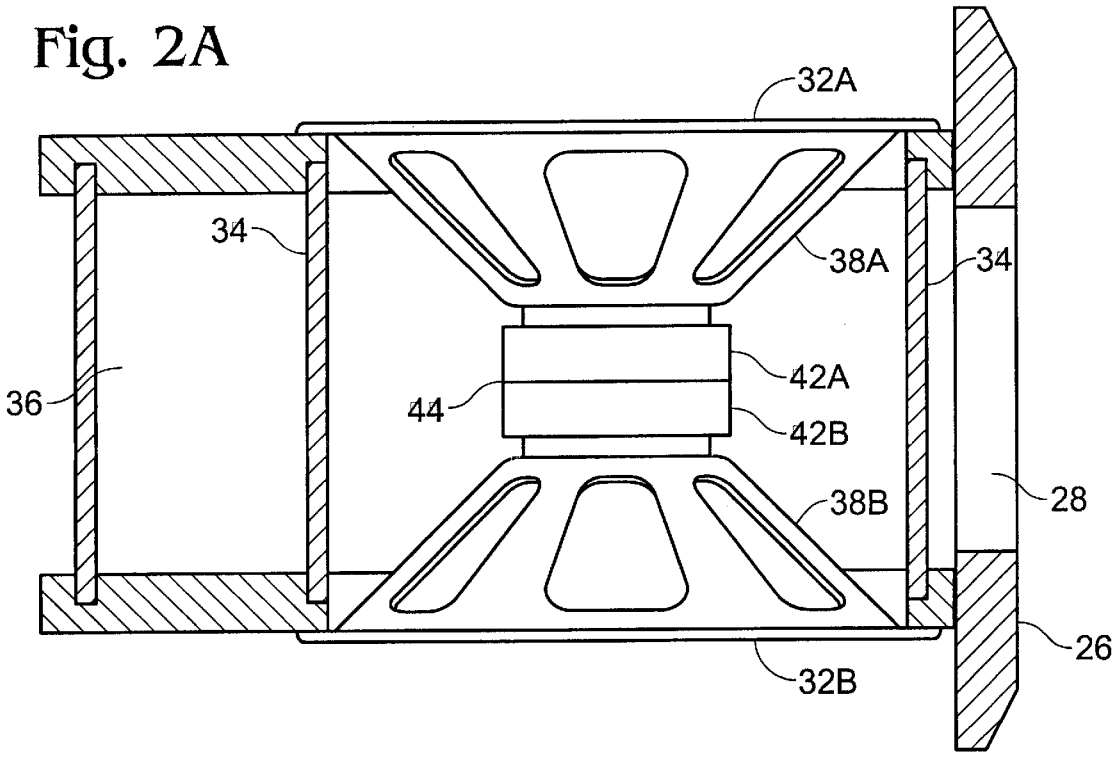
FIG. 2A is a cross-sectional view of one embodiment of the magnet structure of the back to back mounted compound woofer shown in FIG. 1.
Figure 2B:
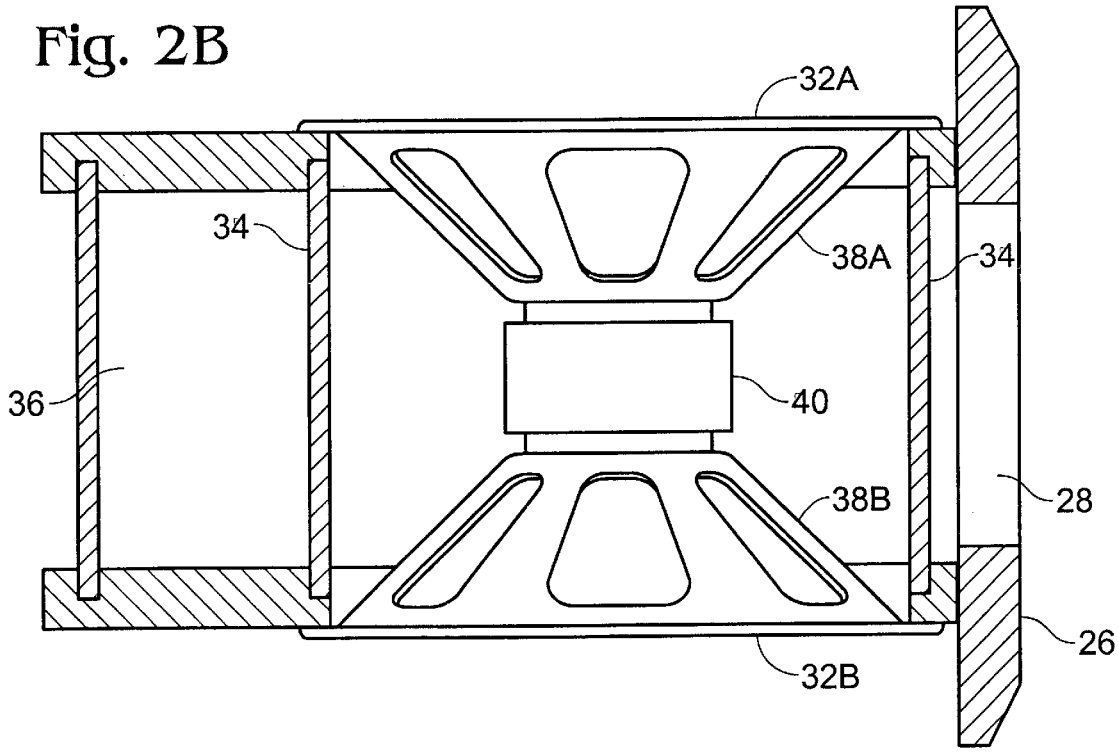
FIG. 2B is a cross-sectional view of another embodiment of the magnet structure of the back to back mounted compound woofer shown in FIG. 1.

The compound woofer 10 includes two speakers 32A and 32B as best shown in FIGS. 2A and 2B. The speaker 32A includes a cone section 38A at a first end and a magnet structure 42A at a second end. Similarly, the speaker 32B includes a cone section 38B at a first end and a magnet structure 42B at a second end. As mentioned above, the speakers 32A and 32B are mounted at their respective cone ends 38A and 38B to the coaxial opening 30 of a respective sidewall 16. Additionally, the speakers 32A and 32B are mounted back to back.

One embodiment of the compound woofer 10 is shown in FIG. 2A. In FIG. 2A, the speakers 32A and 32B have distinct and separable magnet structures 42A and 42B that are placed in close proximity to one another. In the preferred embodiment, the magnet structures 42A and 42B are joined together using a sealing compound 44. The sealing compound can be any of a variety of flexible adhesives, e.g., putty. The magnet structures 42A and 42B are preferably about 1–2 millimeters apart from each other.

Another embodiment of the compound woofer 10 is shown in FIG. 2B where the speakers 32A and 32B share a common unitary magnet structure 40. The unitary magnet structure 40 obviates the need for the sealing compound 44 and reduces the overall weight of the compound speaker. The unity magnet 40 makes more efficient use of the available magnetic material and eliminates the usual back plates of the two district magnet structures 42A and 42B. The main benefit of the unitary magnet 40 is a large reduction in the overall weight of the system for a given result—most important for car applications.

Figure 3:
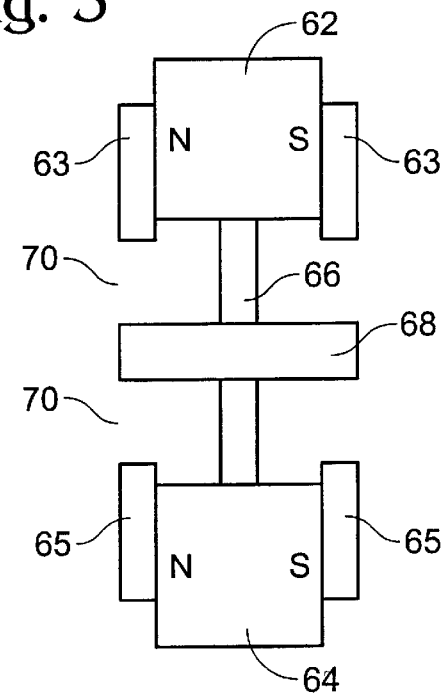
FIG. 3 is a diagram of the unitary magnet shown in FIG. 2B.

Referring to FIG. 3, the unitary magnet 40 comprises a top ring magnet 62 sandwiched between two top plates 63. A bottom ring magnet 64 is also sandwiched between two plates 65.

A long central pole piece 68 is suspended from a non-ferrous pole suspension ring 66. The pole piece 68 forms the return path for the two annular magnetic gaps thus formed. The unitary magnet 40 shown in FIGS. 2B and 3 includes magnetic common to moving cone assemblies. The operation of unitary magnets, like unitary magnet 40, is well known and will not be described in further detail.

In either of the two embodiments shown in FIGS. 2A and 2B, the speakers 32A and 32B are in such close proximity to each other to achieve magnetic coupling resulting in inherent magnetic shielding. That is, the magnetic fields of the magnet structures 42A, 42B, and 40 cancel each other. In some applications, e.g., TV or video, additional shielding may be desirable to further reduce electromagnetic interference. A simple metal sleeve (not shown) over the magnet structures 42A and 42B or 40 can be used as the additional shielding.

The above-described mounting configuration results in the speakers being placed under a compressive load that improves cone motion control and lowers the cutoff and, thus, resonant frequency. The point of resonance is the point of maximum efficiency of a speaker. In a woofer system, the resonant frequency is important because it defines the maximum power output for a given power input. The cutoff frequency is optimized for the type of system designed. For example, the cutoff frequency in a car woofer system is set to around 80 Hz because of the added boost inherent in such enclosed environments. Setting the frequency response in a car woofer system to 80 Hz ensures a smooth response down to about 35–40 Hz. If, for example, the cutoff frequency in a car woofer system is set around 40 Hz, a generally undesirable deep bass dominates the sound output.

Unlike conventional woofer systems where the output of the system is at the cone of the speakers, the output of the compound woofer 10 is at the magnet structures 42A and 42B. The back to back mounting configuration of the speakers 32A and 32B allows the cones 38A and 38B to move together in an additive manner. The back to back mounting configuration cancels out the displacement of the magnet structures 42A and 42B because they move at the same time in opposite directions. At the same time, the magnet structures 42A and 42B do not displace because they are magnetically coupled to one another as explained above. The result is an elimination of the mechanical vibration of both the cones 38A and 38B and the magnet structures 42A and 42B shown in FIG. 2A or the magnet structure 40 shown in FIG. 2B. Minimization of the mechanical vibration of the speakers 32A and 32B eliminates unwanted noise propagating through the system improving overall sound performance.

Figure 4A:
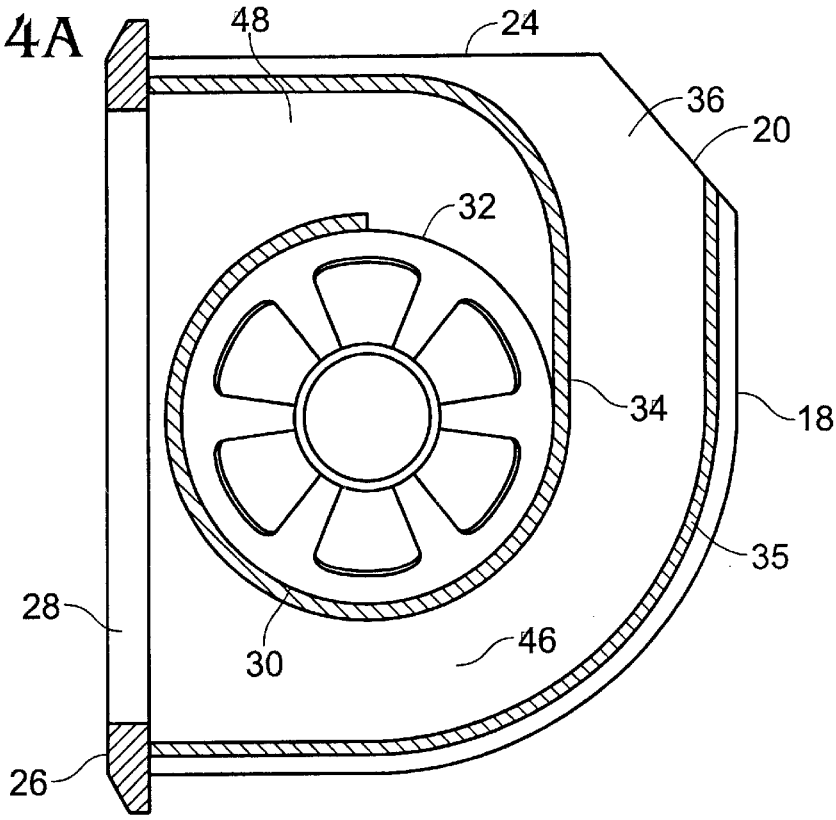
FIG. 4A is a side view of the back to back mounted compound woofer shown in FIG. 1.

Referring now to FIG. 4A, the housing 14 includes a first channel or vent 46 defined by the curve member 35 on one side and by the spiral curve member 34 on the other. The first channel 46 is sized to minimize sound distortion. The bigger the first channel 46, the lower the sound distortion. The first channel 46 is preferably sized equal in cross sectional area to a second channel 48 that forms the main exhaust out of the speakers 32A and 32B. The curved shape of the first channel 46 allows for a relatively long vent in a relatively small enclosure. The housing 14 also includes a second channel 48 defined by the spiral curve member 34. As mentioned above, the second channel 48 is the main exit or exhaust 36 of the speakers 32A and 32B.

Figure 4B:
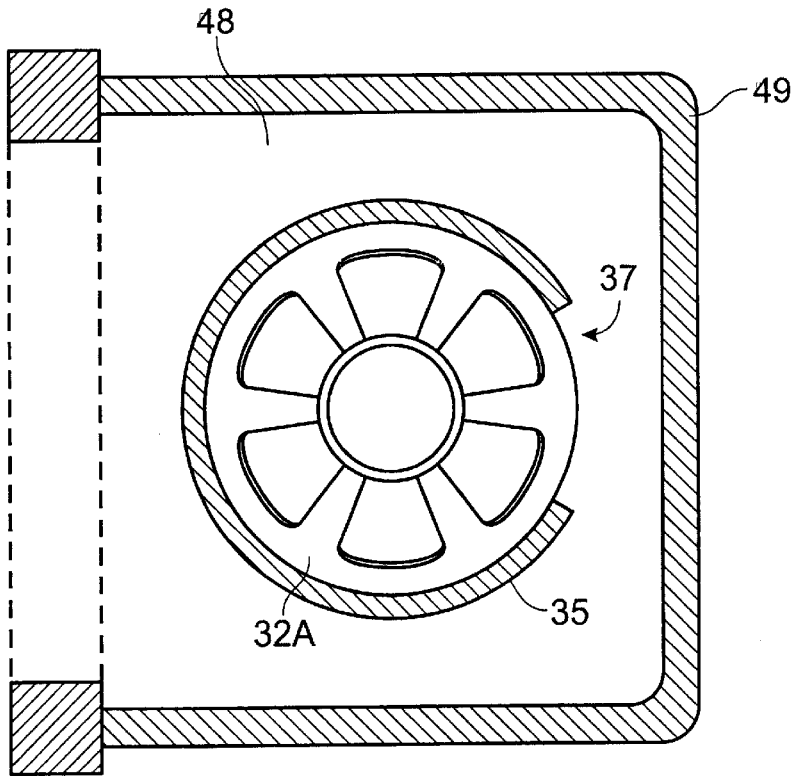
FIG. 4B is a side view of another embodiment of the back to back mounted compound woofer shown in FIG. 1.

Another embodiment of the compound woofer 10 is shown in FIG. 4B. In FIG. 4B, the housing 14 includes an outer member 39 surrounding a curve member 35. Curve member 35 forms a substantially circular speaker housing. Curve member 35 includes an opening 37 in communication with a single channel 49 that surrounds the speakers 32A and 32B. Opening 37 and channel 49 serves as the main exhaust for speakers 32A and 32B.

The compression of the first and second enclosed channels 46 and 48, respectively, on the speakers 32A and 32B is about ⅕ to ⅙ of the cone areas 38A and 38B, respectively. The compression ratios disclosed were arrived at empirically. Other compression ratios are possible. The tighter the compression ratio, the smaller the overall enclosure can be for a given low frequency cutoff—all other things being equal. However, conversion efficiency is reduced as the compression ratio tightens.

Figure 5:
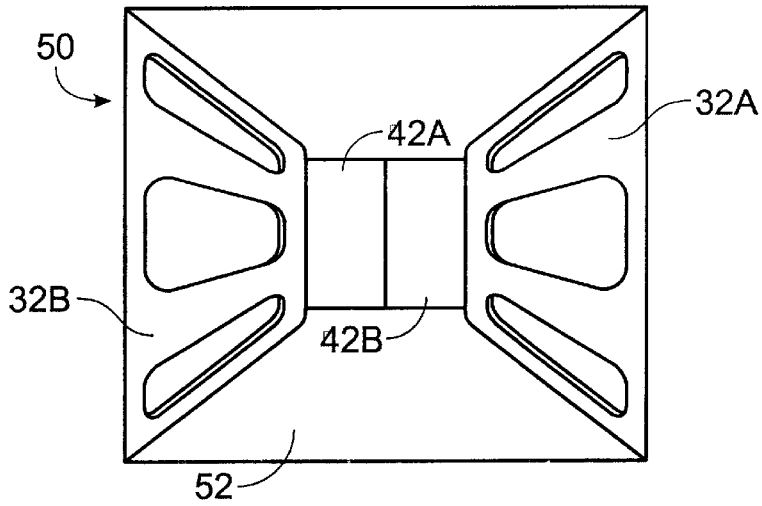
FIG. 5 is a side view of a second embodiment of the back to back mounted compound woofer of the present invention.

Referring to FIG. 5, the compound woofer 50 includes a pair of speakers 32A and 32B mounted in housing 51. The speakers 32A and 32B are identical and wired in-phase with each other as in the embodiment shown in FIG. 1. The speakers 32A and 32B are mounted to coaxial openings on respective opposed sidewalls (not shown) in a similar fashion to that described for the compound woofer 10 shown in FIG. 1. The speakers 32A and 32B include respective magnet structures 42A and 42B that are brought in close proximity to one another. In one embodiment, the magnet structures 42A and 42B are sealed together using a sealing compound, e.g., putty, in between. Although not shown in FIG. 5, a person skilled in the art should recognize that speakers 32A and 32B could share a common unitary magnet such as unitary magnet 40 shown in FIG. 2B.

Figure 6A:
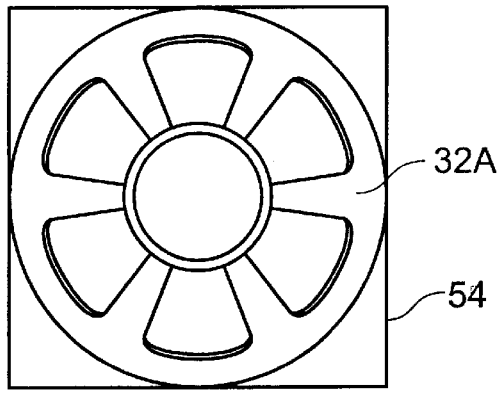
FIG. 6A is an end view of one embodiment of the housing for the back to back mounted compound woofer shown in FIG. 5.
Figure 6B:
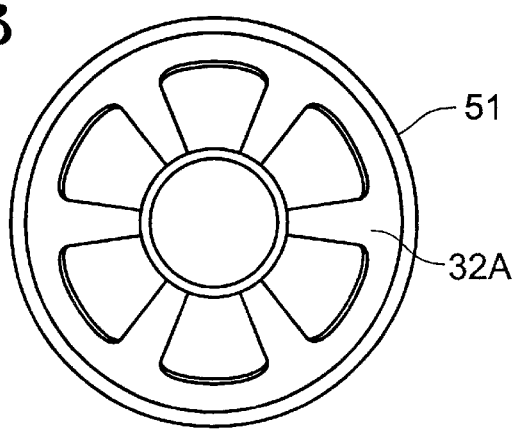
FIG. 6B is an end view of another embodiment of the housing for the back to back mounted compound woofer shown in FIG. 5.

Referring to FIGS. 6A–6B, the housing 51 is constructed having a minimal size around the speakers 32A and 32B. In the embodiment shown in FIG. 6A, the housing is a six-sided box 54. In the preferred embodiment shown in FIG. 6B, the housing 51 is a tube. The speakers 32A and 32B are under a compressive load, rarefying the volume 52 of the housing 51 in step with the applied audio signal.

Figure 7:
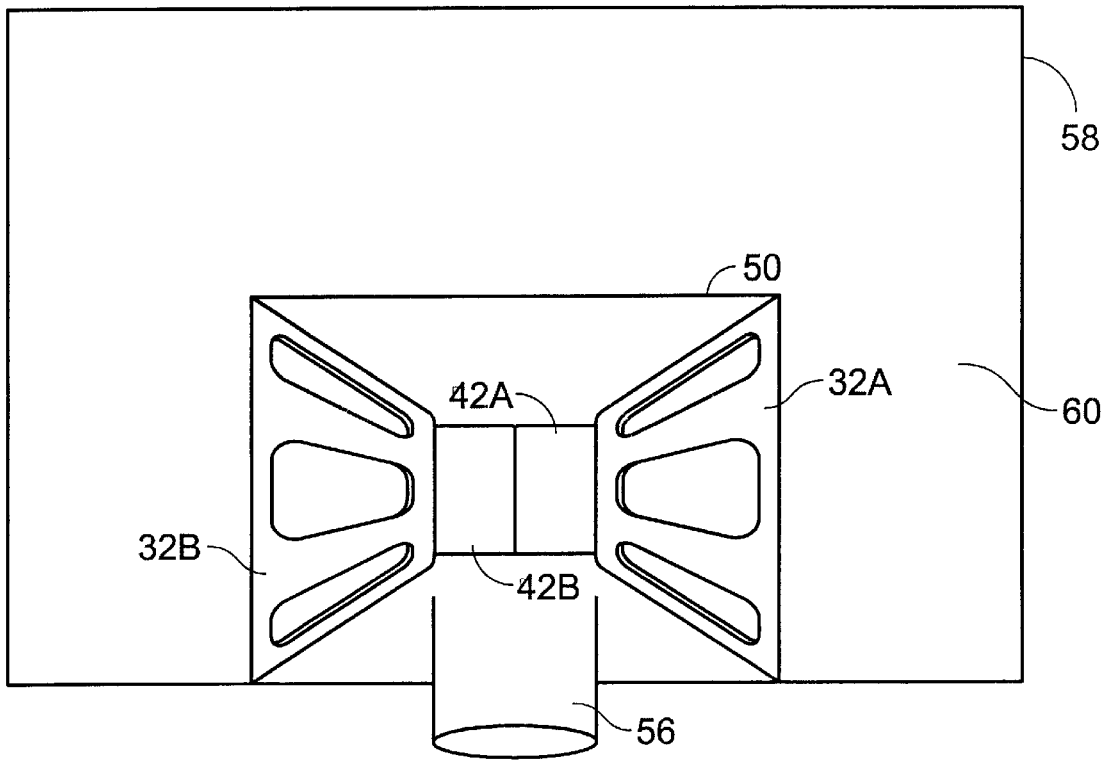
FIG. 7 is a side view of the second embodiment of the back to back mounted compound woofer of the present invention with a vent.
Figure 8:
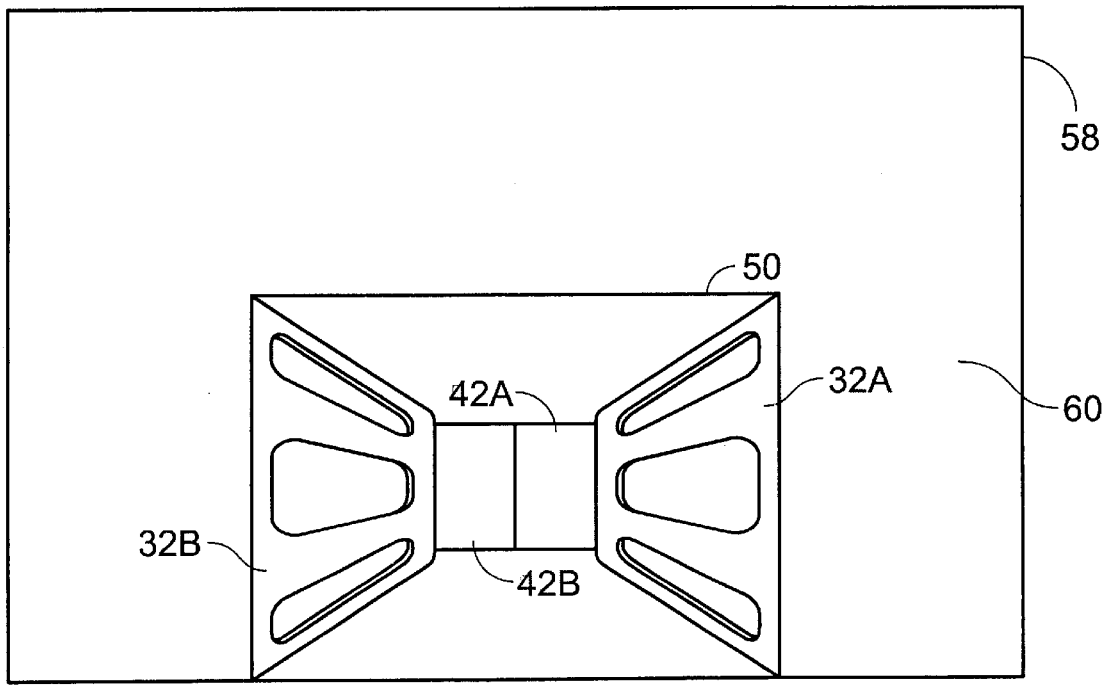
FIG. 8 is a side view of the second embodiment of the back to back mounted compound woofer of the present invention without a vent.

Referring to FIGS. 7–8, the cones 38A and 38B of the speakers 32A and 32B, respectively, radiate away from each other and into an enclosure 58 having a back volume 60. The enclosure 58 can be sealed (FIG. 8) or vented using a vent 56 (FIG. 7). The vent 56 preferably has a tubular shape. The vent 56 has a size and volume that are determined relative to the size of the speakers used and the frequency response desired. In the preferred embodiment, the vent 56 has a diameter about ⅕ the working cone area of the speakers 32A or 32B and a vent length equal to about twice the diameter of the vent. An advantage of this system is that the tube housing 51 (FIG. 6B) or box housing 54 (FIG. 6A) is much smaller than that used for the conventional band pass system.

The compound woofers 10 and 50 can be used with 4, 6, or 8-inch speakers. However, using 8-inch speakers is preferred in the embodiment shown in FIG. 1 since it provides for a containment volume of about 2 cubic feet and high performance down to about 20 Hz. Using 8-inch speakers also allows the thickness of the sidewalls 16 to be about ½ inch substantially reducing its cost relative to conventional woofer systems requiring ¾ inch thick walls with additional bracing.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A balanced compound compression woofer, comprising:

a housing having opposed sidewalls, and including a spiral curve member defining a substantially circular woofer housing;

a coaxial opening in each of the sidewalls;

a pair of speakers mounted back to back in the housing, each speaker including a cone having a cross-sectional area, and being attached to a respective sidewall;

an enclosure for containing the housing; and a tubular vent connecting the housing and the enclosure for venting the pair of speaker, the vent having a diameter substantially equal to one-fifth of the cone cross-sectional area, and a length substantially equal to twice the vent diameter.

2. A balanced compound compression woofer, comprising:

a housing having opposed sidewalls, and including a spiral curve member defining a substantially circular woofer housing;

a coaxial opening in the sidewalls;

a pair of speakers mounted back to back in the housing, each speaker being attached to a respective sidewall and the housing having a size minimized to allow for mounting the pair of speakers;

a magnet operatively connected to each of the pair of speakers and operable to deflect each speaker responsive to an electrical signal, each of the pair of speakers in phase with the other when deflected by the magnet;

an enclosure for containing the housing; and a tubular vent connecting the housing and the enclosure for venting the pair of speakers;

each of the pair of speakers including a cone having a cone area and wherein the vent has a vent diameter substantially equal to one-fifth of the cone area and a vent length substantially equal to twice the vent diameter.

3. The balanced compound compression woofer of claim 2 wherein the housing and the spiral curve member define a first enclosed channel for venting the pair of speakers.

4. The balanced compound compression woofer of claim 2 wherein the housing includes an exit in communication with a first enclosed channel, the first enclosed channel being formed by the housing and the spiral curve member.

5. The balanced compound compression woofer of claim 4 including a faceplate having an opening for providing a primary sound output for the woofer.

6. The balanced compound compression woofer of claim 5 wherein each sidewall includes a curved, a sloped, a straight, and a face portion, the sloped portion communicating with the exit.

7. The balanced compound compression woofer of claim 6 wherein the spiral curve member defines a second enclosed channel, the first and second enclosed channels communicating with the faceplate.

8. The balanced compound compression woofer of claim 2 wherein each of the pair of speakers includes a magnet structure, the pair of speakers being mounted with their respective magnet structures in close proximity with one another.

9. The balanced compound compression woofer of claim 8 including a sealing agent in between the magnet structures.

10. The balanced compound compression woofer of claim 9 wherein the sealing agent is putty.

11. The balanced compound compression woofer of claim 8 wherein the magnet structures of the pair of speakers are close enough to achieve magnetic cancellation.

12. The balanced compound compression woofer of claim 11 wherein the magnet structures are spaced about 1–2 millimeters from each other.

13. The balanced compound compression woofer of claim 8 wherein the pair of speakers is mounted with their respective magnet structures in contact with one another.

14. The balanced compound compression woofer of claim 2 wherein the pair of speakers includes a common unitary magnet.

15. The balanced compound compression woofer of claim 2 wherein the housing is a box.

16. The balanced compound compression woofer of claim 2 wherein the housing is a tube.

* * * * *